United States Patent [19]

Schneider et al.

[11] Patent Number: 4,600,439

[45] Date of Patent: Jul. 15, 1986

[54] COMPOSITION AND PROCESS FOR COATING PAPER AND CARDBOARD PROCESS FOR PREPARING THE COMPOSITIONS AND PAPER AND CARDBOARD SO OBTAINED

[75] Inventors: Jean Schneider, La Gorgue; Serge Gosset, Lestrem; Pierre Lefer, Merville, all of France

[73] Assignee: Roquette Freres, France

[21] Appl. No.: 541,236

[22] Filed: Oct. 12, 1983

[30] Foreign Application Priority Data

Oct. 12, 1982 [FR] France ..... 82 17085

[51] Int. Cl.[4] ..... C08L 89/00; B32B 23/04

[52] U.S. Cl. ..... 106/139; 106/157; 106/214; 428/533; 524/57; 524/47

[58] Field of Search ..... 524/57; 106/213, 214, 106/157; 428/533

[56] References Cited

U.S. PATENT DOCUMENTS

| | | | |
|---|---|---|---|
| 1,733,524 | 10/1929 | Bradner | 427/377 |
| 2,287,161 | 6/1942 | Ball | 106/214 |
| 3,222,220 | 12/1965 | Wurzburg et al. | 127/32 |
| 3,462,283 | 8/1969 | Hjermstad | 106/213 |
| 3,632,786 | 1/1972 | Nickerson | 106/213 |
| 4,173,488 | 11/1979 | Vassiliades | 106/213 |
| 4,187,219 | 2/1980 | Maher | 428/512 |

FOREIGN PATENT DOCUMENTS

| | | |
|---|---|---|
| 2411866 | 7/1979 | France . |
| 2447388 | 8/1980 | France . |

OTHER PUBLICATIONS

Chem Abst 74: 133,343k, George et al, Mar. 71.

Chem Abst 71: 114,262h, Walter et al, Sep. 69.

Chemistry & Industry of Starch, Kerr, 1952 pp. 620–621.

"Starch/Starke", vol. 31, No. 5, May 1979, pp. 163–165.

*Primary Examiner*—Theodore Morris

*Attorney, Agent, or Firm*—Larson and Taylor

[57] ABSTRACT

The invention relates to a coating composition for paper and cardboard comprising, besides the usual pigments, a fluidizing agent and, by way of binder, an undepolymerized starch possibly modified, as well as, generally, one or several synthetic products and/or one or several proteins.

7 Claims, No Drawings

COMPOSITION AND PROCESS FOR COATING PAPER AND CARDBOARD PROCESS FOR PREPARING THE COMPOSITIONS AND PAPER AND CARDBOARD SO OBTAINED

The present invention relates to an aqueous composition for the coating of paper and of cardboard.

It also relates to a process for coating paper employing said composition, as well as a process for preparing the latter.

Finally it relates also to the papers and cardboards obtained, that is to say "coated" by means of said composition.

By the technical term "coating", is meant the operation consisting on depositing on one or on both surfaces of a support sheet of paper or cardboard, a coating composition forming a coat; this coat confers on the treated sheet a particularly regular surface condition and hence adapted to receive well, fine printing, whilst improving the opaqueness and the appearance of paper (whiteness, smoothness, shine).

A coating composition comprises at least two constituents, namely a pigment and a binder, also called adhesive.

The first of these constituents, the pigment, takes part as follows during the coating operation.

The paper is constituted by fibres of variable dimensions which, in spite of the usual hot pressing operation, allow to subsist, on the one hand, at the surface cavities whose dimensions are of the order of 50 to 100 microns and, on the other hand, in the thickness of the paper, more or less wide channels, denoted by the term macrocapillaries. When, during the coating operation, the surface is covered with a coat based on very fine pigments, the latter come to fill in the cavities thereby levelling the surface; the channels comprised by the layer thus applied are extremely fine: they are microcapillaries of a width of the order of 2 to 5 microns. During the printing of coated papers, the pigments of the ink, which are coarser than the channels of the layer, remain at the surface whereas the support of the ink pigment which is constituted by oils and solvents is easily absorbed by the micro-capillaries, due to which the quality of the printing is improved.

To constitute the pigment of the coating composition, recourse is generally had to an aqueous china clay or kaolin dispersion; it is also possible to use, either separately, or mostly in admixture with the clay, other pigments such as particularly calcium carbonate, titanium oxide, calcium sulfate, satin white ($CaSO_4+Al_2O_3$) or very fine talc.

To constitute the binder of the coating composition, recourse is generally had to starches, proteins like casein or soya protein, or to synthetic products such as polyvinyl alcohol, polyvinyl acetate, acrylic products, styrene-butadiene. The composition can contain one only of these products, but often they are used in admixture. The amount of binder represents generally from 5 to 30% of the weight of pigment. This amount is chosen particularly according to the nature of pigment, according to the coating process used and according to the qualities sought for the paper or the cardboard. By way of example, it is indicated that it is convenient to employ more binder in the case of carbonate and satin white than in the case of clay, and in the case of finely divided fillers than in the case of coarse fillers.

Besides the pigment of the binders, a coating composition comprises various additional agents among which may be mentioned foam reducers, preserving agents, dyes, dispersing agents or defloculating agents like tripolyphosphate, pyrophosphate or hexametaphosphate and the salts of polycarboxylic acids which retard particularly the sedimentation of the suspensions.

The formulation of the coating composition varies according to the technique of application, the qualities of the support paper or of the properties sought, the latter being different according to the printing method (photogravure, typographic printing, offset, flexographic printing, silk screen printing) for which the coated papers are intended.

It is to be noted finally that simply the energy aspect leads to the search, for a given viscosity, for coating compositions having a dry extract as high as possible, so that the expenditure of energy necessary for obtaining a dry coated paper is as low as possible.

The starches used uptill now, alone or in admixture with proteins or the above mentioned synthetic substances to constitute the binder of the coating composition, are depolymerized starches, possibly modified in addition by etherification or esterification.

It has been in fact very difficult, even practically impossible, to resort to undepolymerized starch in coating compositions, particularly by reason of the difficulty of obtaining, from an undepolymerized starch, a correct colloidal solution, considering that undepolymerized starch sols cooked 90 minutes on a water-bath still have highly swollen granules. And even when correct sols of undepolymerized starch are obtained, the latter have an excessive viscosity, aggravated by the tendency of the molecules to reassociation or retrogradation, which prevent in fact their practical application in coating compositions.

The starches at present used in coating are depolymerised by acid or enzymatic hydrolysis, by oxidation, or by dextrinification, certain of these degradations (enzymatic or oxidising) being realisable directly on the user's premises. Thus it is to improve certain properties (like bonding or "glaze" properties) of the coating containing starch as binder, that it is possible to proceed, either before, or after the depolymerization reaction, with chemical modifications like etherification or esterification (acetylation, cationization, hydroxyethylenation or hydroxypropylenation, for example).

It happens that at present users prefer to reduce the proportion of depolymerized starch present in the constituent binder of the coating compositions in favour of the above-identified synthetic products; the latter enter even alone into the constitution of binders used in coating compositions employed in certain suitable installations.

This disaffection with respect to depolymerized starches must be attributed among other things to:

their relatively low binding power, their mediocre water retaining properties due to the small size of the depolymerized starch molecules, this small size moreover facilitating the penetration of the coating layer into the treated sheet reducing the solidity and strength of the layer.

In addition, migration phenomena, essentially on drying are considerable.

Now, the cost of synthetic products is very high and in any case well above that of depolymerized and possibly modified starches.

It follows that there exists in the paper and cardboard industry the need for a product which can constitute the binder of the coating compositions and which is more economical than the synthetic products at present more and more used and which does not have the defects of depolymerized starches of which the principal ones are recalled above.

The well known properties of undepolymerized starches are such that the latter would respond to the above said need if the practically unsurmontable difficulties of preparation of correct sols of acceptable viscosity based on these undepolymerized starches did not prohibit their use.

Now, Applicants have had the merit of discovering that, surprisingly and unexpectingly, it was possible to use undepolymerized starches in the constitution of binders for coating compositions as soon as these undepolymerised starches were used at the same time as an effective proportion of at least one so called "fluidizing" agent selected from the group constituted by hydrogenated sugars comprising sorbitol, mannitol, maltitol, xylitol, lactitol and hydrogenated starch hydrolysates.

Accordingly, the aqueous coating composition according to the invention is characterized by the fact that it comprises, besides the pigment:

one or several fluidizing agents selected from the group constituted by hydrogenated sugars comprising particularly sorbitol, mannitol, maltitol, xylitol, lactitol and hydrogenated starch hydrolysates, the proportion of fluidizing agent being from 0.40 to 20 parts by weight per 100 parts of pigment, and as binder, one or several undepolymerized starches, possibly modified by etherification, esterification or cross-linking.

Generally, this composition comprises also one or several synthetic products of the group comprising particularly polyvinyl alcohol, polyvinyl acetate, acrylic products, styrene-butadiene, synthetic copolymers and/or one or several proteins selected particularly from the group comprising casein and soya proteins.

By the expression "undepolymerized starches", is meant starches which have not undergone a depolymerization treatment such as particularly acid or enzymatic hydrolysis, oxidizing degradation or dextrinification. They may be selected from among starches from any source and particularly from among corn starches, possibly hybrid, wheat starch and rice, potato flour, manioc starch. In addition, as already mentioned previously, these starches can have been etherified, esterified or cross-linked in order to modify certain of their properties like, for example, their stability in solution.

The presence of fluidizing agents enables the coating composition to be given a viscosity and a texture fully adapted to the coating of paper.

The use of undepolymerized starches enables all the previously described drawbacks to be overcome, which are associated with the use of degraded starches, and enables particularly higher binding power to be obtained, a better strength of the layer, a better water retention and a better homogeneity of the surface.

It is appropriate to stress that the effect of the fluidizing agent used according to the invention is very different from the effect of the dispersing or defloculating agents commonly used in the pigment dispersions and which will be considered.

A given pigment is essentially characterized, not only by its chemical composition, but also by the size and the disposition of its constituent particles.

In general, the latter are stuck to one another, and the number of possibilities of aggregation is unlimited; they can thus be grouped into "clusters" grouping few or many individual particles more or less tightly against one another.

The description of the behaviour of the particles in the cluster is also important: number of particles, mobility or lack of mobility, breakage strength or resistance to rearrangement of the cluster and surface condition of the cluster.

It is assumed that the dispersion of the pigment is produced when rupture of the clusters of pigment particles is produced.

The constituent particles of the cluster can be coupled to one another by chemical bonds at the contact points, giving the clusters a strength almost equal to that of individual particles of the same size; they can also be rather weakly bound to one another as if they were attracted by magnetic or gravitational forces (Van de Waals force), these particular arrangements being "disturbable" or "breakable" by the application of a force.

The dislocation of the clusters of particles bound by chemical linkages at their contact points is denoted by the term "disagregation". After disagregation or separation of the particles, the bonds are not reformed, the disagregation process hence being irreversible.

The dislocation of the clusters of particles bound by Van de Waals type forces is denoted by the term "defloculation". This phenomenon is reversible. This reversibility is prevented by introducing into the pigment system chemical products which act on the particle surfaces so that the latter mutually repel each other.

The use of dispersing agents is hence an essential part of the dispersion process which renders the use of mechanical energy effective and which reduces the viscosity of the suspension of pigments.

A coating composition comprises particles of pigments and a binder, in an aqueous solution forming a fluid medium, in which the pigment particles are suspended. The fluid medium does not comprise only the binder or adhesive but also all the other dissolved materials, in particular the fluidizing agents used according to the invention.

Starch or casein, although in colloidal solution, are in a sufficient state of solubility for them to be considered as a part of the fluid.

The fluid medium acts as a lubricant between the particles and permit them to slide over one another much more easily than they could if they were dry.

The small size of the fluidizing agent molecules used according to the invention results in them having considerable mobility; despite this reality, it is surprising to note that the addition of anyone of these agents or of several among them, which leads to an increase in the content of dry matters of the whole, is manifested by a reduction in viscosity such that term "fluidizing agent" seems indispensable to denote the agents entering, according to the invention, in the constitution of the binder.

This effect of diminution of viscosity is not produced by the increase in the ratio of dispersing or defloculating agents commonly used in pigment dispersions; quite to the contrary, it is known that the increase in the ratio of incorporation of these products results, beyond the optimum ratio of utilisation, a very rapid rise in the viscosity of the coating preparation.

It is hence indeed the selection of the fluidizing agents used according to the invention which permits the use, as binding agent, of undepolymerized starches.

The process of coating paper or cardboard according to the invention is characterized by the fact that there is applied, on one or both surfaces of the paper and of the cardboard, the aqueous coating composition according to the invention.

Any conventional devices and equipment such brush coating devices or spreaders, CHAMPION spreaders, air sheet spreaders or scrapers, multiple roller spreaders or engraved roller spreaders, BILL-BLADE type spreaders and the like may be used for this application.

The process of preparing the aqueous coating composition according to the invention is characterized by the fact that there is prepared, on the one hand, an undepolymerized starch glue, on the other hand, a pigment dispersion, the mixing of the starch glue and the pigment dispersion is carried out, and an effective proportion of fluidizing agent selected from the group constituted by hydrogenated sugars comprising especially sorbitol, mannitol, maltitol, xylitol, lactitol and hydrogenated starch hydrolysates, is introduced, by the addition either to the water serving for the preparation of the starch glue and/or of the pigment dispersion, or to the starch glue, or to the pigment dispersion, or to the mixture of both of them or to the final coating preparation.

The cooking of the undepolymerized starch may be effected by any suitable technique and particularly by cooking in a live steam injection apparatus.

Preferably, this cooking is effected by a passage of a suspension of undepolymerized starch into an apparatus of the "Jet Cooker" type, well known to starch manufacturers, in which the cooking of the starch is obtained by the introduction of steam at a pressure above the atmospheric pressure. Preferably again, the cooking of undepolymerized starch is done at a dry matter comprised between 5% and 30%, at a temperature above 120° C. and in a time generally greater than 20 seconds, due to which an undepolymerized starch glue is obtained which practically no longer contains highly inflated but nonbursted granules, which are responsible for the viscosity developments and for a lack in stability.

Among the fluidizing agents identified above, there is preferably used sorbitol or hydrogenated starch hydrolystates, obtained by the acid and/or enzymatic hydrolysis of any starches followed by hydrogenation. These hydrogenated starch hydrolysates are constituted principally and in variable proportions according to the method of hydrolysis applied by sorbitol, maltitol, isomaltitol and hydrogenated oligo- and polysaccharides.

More preferably still, recourse is had to sorbitol or to hydrogenated starch hydrolysates from starch hydrolysates having a D.E. (Dextrose Equivalent) higher than 25; there are preferred particularly hydrolysates having a sorbitol percentage higher than 60% expressed on dry matter.

Expressed in dry matter with respect to the amount of pigments, the proportion of fluidizing agent entering into the coating composition according to the invention is about 0.40% to 20% by weight, preferably from 0.50% to 15% by weight, and more preferably still from 0.50% to 7.5% by weight.

The amounts of binders used in the coating compositions according to the invention are from 5 to 30% by weight with respect to the weight of the pigments.

For the constitution of the binder, recourse may be had only to undepolymerized starches but generally other conventional binding agents are used at the same time.

The proportion of undepolymerized starch present in the coating composition according to the invention is established, the percentages being expressed dry/dry, between 0.2 and 30% and, preferably, between 0.5 and 30% by weight to the weight of pigment.

The coating compositions according to the invention of which the binder is constituted at least in part by undepolymerized starch, may be formulated with very high contents of dry matter, of the order of 60 to 70%, whilst having a viscosity compatible with their use on existing coating machines and whilst not giving rise to difficulties, for example in the final operation of filtration of the coating composition, which operation consists of freeing the composition particularly from the agglomerates that it may contain.

It is also in the case of coating compositions having a high dry matter, higher than about 53%, that the effect of the addition of fluidizing agents used according to the invention reveals itself to be the most effective.

Another advantage inherent in the use of the coating compositions according to the invention resides in the better plasticisation of the layer, contributed by the presence in the compositions of hydrogenated sugars and more particularly sorbitol.

The invention will be better understood with the aid of the following examples given purely by way of non-limiting illustration.

EXAMPLE 1

Comparison between two coating compositions according to the prior art comprising as binding systems respectively a depolymerized starch and latex for the first, an undepolymerized starch and a latex for the second.

The pigments used were natural calcium carbonate and kaolin, and the dispersing agent used is constituted by a polyacrylate, sold under the trade mark DISPEX N 40 by the ALLIED COLLOIDS Company.

The first composition was prepared from starch depolymerized enzymatically.

To do this, a suspension of corn starch was treated in a continuous enzymatic converter such as constructed according to French Pat. No. 1,391,011 and marketed by Applicant, the enzymatic conversion being effected for 30 minutes at 85° C. in the presence of 1.4 parts of α-amylase per 1000 parts of starch. The inhibition of the enzyme was effected in the apparatus by a heat flash to 140° C. for 90 seconds.

In addition, a dispersion of pigments was prepared from the following constituents:

| | |
|---|---|
| Potable water | 3600 g |
| "DISPEX N 40" | 35 g |
| Kaolin (of trade mark "DINKIE A", marketed by the (ENGLISH CHINA CLAYS Company) | 6030 g |
| ammonia | 80 ml |
| calcium carbonate, marketed under the trade mark "OMYALITE 90" by the OMYA Company | 2590 g |

treating the mixture by passage in a disintegrator of the CELLIER trade mark for 15 minutes.

To the pigment dispersion so obtained, there was first added 2153 g of the above-said enzymatically depolymerised starch glue having a content of dry matter of 28%, namely 7% of "dry matter/dry matter" (called below "dry/dry" for simplicity) with respect to the pigment. Then, there were added 1380 g of SB 024 latex (marketed by the RHONE POULENC Company) with 50% dry matter, which is equivalent to 8% dry/dry with respect to the pigment.

To prepare the second coating composition, 1725 g of an undepolymerized starch glue having a dry matter of 20% (which is equivalent to 4 parts of starch taken as dry per 100 parts of pigment) was added to a pigment dispersion prepared in the way as previously. Then 1380 g of SB 024 latex with 50% of dry matter was added, namely 8% dry/dry with respect to the pigment.

The undepolymerized starch glue was prepared by passing native corn starch in a Jet-Cooker, at a temperature of 150° C. and for 3 minutes under a pressure of 5 bars.

The viscosities of the two above-said starch glues were measured on a BROOKFIELD type R.V.T. viscosimeter, for a speed of 20 r.p.m.; then they were measured again, the starch glues having been kept on a water bath for 24 hours at 90° C. without and with light shaking. These recorded viscosities are collected in Table 1.

| | % of dry matter | BROOKFIELD Viscosity | BROOKFIELD Viscosity after 24 h | |
|---|---|---|---|---|
| | | | with shaking | without shaking |
| Starch depolymerized enzimatically | 28 | 75 cps | 62.5 cps | 88 cps |
| Undepolymerized starch | 20 | 3000 cps | 3700 cps | 4550 cps |

The viscosities of the two coating compositions were then measured at 30° C., the storage being effected with and without shaking.

The water retention was measured on an inclined plane or ramp and filters of the conventional FANN type of the type used for studying drilling muds, at a pressure of 6.9 bars.

In Table II, the results obtained are collected.

TABLE II

| | Composition based on enzymatically depolymerized starch | | | | Composition on undepolymerized starch | | | |
|---|---|---|---|---|---|---|---|---|
| | 0 h | 3 h with shaking | 24 h with shaking | 24 h without shak. | 0 h | 3 h with shaking | 24 h with shaking | 24 h without shak. |
| Brookfield viscosity type R.V.T. 20 r.p.m. (cps) | 3100 | 4000 | 3800 | 5600 | 8200 | 7400 | 6300 | 9000 |
| Hercules viscosity 1100 r.p.m. (cps) (spindle n° 2.5) | 113 | 164 | 176 | 147 | 326 | 193 | 144 | 215 |
| Dry matter | 61.5 | | | 61.4 | | | | |
| Water retention (in ml of filtration) | | | | | | | | |
| 7 mm 30 | | 0.3 | 0.5 | 0.5 | 0.7 | 0.7 | 0.9 | 0.8 |
| 15 mm | | 0.5 | 0.9 | 0.9 | 1.2 | 1.2 | 1.3 | 1.2 |
| 30 mm | | 1.1 | 1.3 | 1.3 | 1.8 | 1.8 | 2.0 | 1.9 |
| 45 mm | | 1.5 | 1.8 | 1.8 | 2.5 | 2.5 | 2.5 | 2.4 |
| 60 mm | | 1.8 | 2.0 | 1.9 | 2.8 | 2.8 | 3.0 | 2.9 |

It is observed that the viscosity of the coating composition based on undepolymerized starch is very much higher than that of the composition based on an enzymatically depolymerized starch. The HERCULES viscosity, very representative considering the shear applied, is thus practically double that obtained with depolymerized starch; such a viscosity renders practically unapplicable use of the corresponding composition for the coating of paper and cardboard. In particular, the filtration of the composition in order to free it from agglomerates possibly present is rendered extremely difficult.

It is also observed that there is obtained, with the composition based on undepolymerized starch, a very correct water retention, in spite of the use of a substantially lower level of starch (4% instead of 7%).

This confirms the interest of the employment of undepolymerized starch, on condition that one arrives at reducing the viscosity without however spoiling the other characteristics.

EXAMPLE 2

This example illustrates the effect of the addition of sorbitol as a function of the moment selected for this addition to a coating composition containing undepolymerised starch as binder.

To prepare the coating composition, the dispersion in 3500 g of water of the following products was carried out:

| | |
|---|---|
| "DISPEX N 40" dispersing agent | 35 g |
| "DINKIE A" kaolin | 6030 g |
| ammonia | 80 ml |
| "OMYALITE 90" | 2590 g |

using an apparatus of the CELLIER type for 30 minutes.

Then to the dispersion about 1725 g of an undepolymerised corn starch glue with 20% of dry matter prepared on a Jet-Cooker under the same conditions as in Example 1, namely 4% dry starch with respect to pigments, was added.

There was then added 1380 g of latex SB 024, namely 8% dry matter with respect to the pigments.

To several samples of this composition, there were added each time 160 g of a solution of sorbitol NEOSORB 70/02 ® to 70% of dry matter, namely 0.7% of dry sorbitol with respect to the whole of the composition or 1.29% dry/dry with respect to the pigments, the sorbitol additions being effected at different phases of the preparation, namely:

addition in the pigment dispersion, after 25 minutes of dispersion (preparation A)

addition at the end of the preparation, after the introduction of the latex (preparation B)

addition both to the pigment dispersion and to the final preparation after the introduction of the latex, in two equal parts, namely 80 g in the dispersion and 80 g in the final preparation (preparation C).

For the preparation without sorbitol and for each of the other preparations so produced, the viscosities as well as the water retention were measured and the figures are collected in Table III.

TABLE III

| | BROOKFIELD Viscosity (20 r.p.m.) | HERCULES Viscosity (spindle n° 1) | Dry matter % | Water retention 10 mn | Water retention 60 mn |
|---|---|---|---|---|---|
| Preparation without sorbitol | 13500 cp | 3196 cp | 62.4 | 0.7 | 2.6 |
| Preparation A | 8800 cp | 2327 cp | 62.4 | 0.8 | 2.5 |
| Preparation B | 7000 cp | 1682 cp | 62.4 | 0.8 | 2.7 |
| Preparation C | 7800 cp | 2187 cp | 62.4 | — | — |

It is observed that, whatever the phase of introduction, the addition of 0.7% of sorbitol to the coating composition enables the viscosity to be very significantly reduced.

The water retention and migration characteristics are not affected by the addition of sorbitol.

EXAMPLE 3

Influence of the proportion (increasing ratios) of sorbitol in a coating composition containing undepolymerized starch as binding agent.

The following formula is used:

| | |
|---|---|
| water | 5400 g |
| "DISPEX N 40" | 52.5 g |
| "DINKIE A" kaolin | 9045 g |
| ammonia | 120 ml |
| "OMYALITE 90" | 3860 g. |

The kaolin represents therefore 70% of the total filler and the calcium carbonate 30%.

The dispersion of the pigments was carried out in 15 minutes at high speed on a CELLIER dispersor.

Then to the pigment dispersion thus obtained was added an undepolymerized corn starch glue with 20% of dry matter, prepared under the same conditions as in Example 1, the amount added being 2587 g, namely 4% dry/dry with respect to the pigments.

To the whole, was then added 2070 g of SB 024 latex, namely 8% dry/dry.

To different identical samples of the composition so prepared, were then added increasing proportions of sorbitol in the form of a solution having 70% of dry matter such as that marketed by Applicant Company under the trade mark NEOSORB 70/72®. The ratio of introduction was from 0 to 2.1% of dry sorbitol with respect to the whole of the coating preparation.

The viscosity measurements are collected in Table IV.

TABLE IV

| PERCENTAGE of sorbitol (%) | BROOKFIELD VISCOSITY Type RVT - 20 r.p.m. (spindle n° 5) | HERCULES VISCOSITY 1100 r.p.m. (spindle n° 2.5) |
|---|---|---|
| 0 | 8900 cp | 357 cp |
| 0.35 | 6300 cp | 286 cp |
| 0.70 | 5100 cp | 241 cp |
| 1.40 | 4400 cp | 215 cp |
| 2.10 | 4200 cp | 170 cp |

On examining these results, it is observed that the effect of the sorbitol increases with the percentage introduced, the fluidizing effect not passing through a maximum. There is here a fundamental difference with respect to the effects recorded only under the influence of pigment dispersing agents.

In particular, for a sorbitol ratio of 2.1% with respect to the whole of the formula, the viscosity is reduced by half.

In these measurements, the pH was 8.8 and the content of dry matter about 62%.

Under the same conditions, the water retention was then studied using a ramp and FANN filters. The pressure was 6.9 bars, obtained by means of compressed air.

The results are collected in Table V.

TABLE V

| PERCENTAGE OF SORBITOL | FILTRATE (in ml) AFTER 7.5 mn | 15 mn | 30 mn | 60 mn |
|---|---|---|---|---|
| 0 | 1 | 1.3 | 1.9 | 2.8 |
| 0.35 | 1 | 1.3 | 2.0 | 2.9 |
| 0.70 | 0.9 | 1.2 | 1.8 | 2.7 |
| 1.40 | 0.8 | 1.1 | 1.7 | 2.5 |
| 2.10 | 1 | 1.3 | 2 | 3 |

It is observed, in view of these results, that the water retention is not disturbed by the presence of the sorbitol, even in large amount.

Moreover, it is observed that the composition according to the invention does not give rise to troublesome migration effects.

Then and still by means of the above said compositions, coating tests followed on a previously surfaced paper support of 70 g/m$^2$.

The speed of the coating machine was 140 meters/minute, the temperature of the dryer 170° C. and the deposit (amount of composition per unit surface area) 12 g/m$^2$.

The tests to which so "coated" papers were then subjected were:

the so-called "Dennisson waxes" test (TAPPI standard T 459 os 75), the so-called "IGT-ink 3805" test (TAPPI standard T 499 su 64) and the so-called "wet IGT-3801 ink" test (TAPPI standard T 499 su 64).

The results obtained in these tests are collected in Table VI.

TABLE VI

| Proportion of sorbitol (%) | TESTS DENNISSON waxes | IGT ink 3805 | Wet IGT ink 3801 |
|---|---|---|---|
| 0 | 8 LA (1) | 80 cm | good |
| 0.35 | 8 | sup. 121 cm | good |
| 0.70 | 9 LA | sup. 121 cm | good |

TABLE VI-continued

| Proportion of sorbitol (%) | TESTS DENNISSON waxes | IGT ink 3805 | Wet IGT ink 3801 |
|---|---|---|---|
| 1.40 | 9 LA | sup. 121 cm | good |
| 2.10 | 9 | sup. 121 cm | good |

(1) LA: Slight Separation.

It is observed that the DENNISSON waxes test is slightly improved by the use of sorbitol. It follows that the surface strength is better.

The IGT test is also appreciably improved.

EXAMPLE 4

Comparison between the viscosity of an undepolymerized starch based coating composition not containing a fluidizing agent and the viscosities of various coating compositions according to the invention comprising various hydrogenated sugars.

The formula and the method of preparation of the controlled coating composition were the same as in Example 2.

The ratio of incorporation of the various fluidizing agents tests was in all cases 1.29% dry/dry with respect to the pigments, the fluidizing agents having been added in the final preparation.

The fluidizing agents tested were:

a sorbitol solution marketed under the trade mark NEOSORB 70/02 ®, a hydrogenated starch hydrolysate n°1, a hydrogenated starch hydrolysate n°2, mannitol, xylitol.

The hydrogenated starch hydrolysate n°.1 corresponds to that marketed by the Applicant Company under the trademark NEOSORB 70/70 ®; it has the following composition, the percentages being expressed on dry matter:

| | |
|---|---|
| sorbitol | 74% |
| hydrogenated disaccharides | 20% |
| other hydrogenated saccharides | 6%. |

The hydrogenated starch hydrolysate n°2, obtained by hydrogenation of a starch hydrolysate of D.E. equal to 33, had the following composition:

| | |
|---|---|
| sorbitol | 6.5% |
| maltitol | 26% |
| DP 3 (product of degree of polymerization equal to 3) | 20% |
| DP 4 | 10% |
| DP 5 to DP 9 | 16% |
| DP 10 to DP 20 | 14% |
| DP higher than 20 | 7.5% |

The results of the viscosity measurements are collected in Table VII.

TABLE VII

| | BROOKFIELD VISCOSITY (cps) (20 r.p.m.) | HERCULES VISCOSITY (cps) (spindle n° 1) |
|---|---|---|
| Control | 13500 | 3196 |
| Sorbitol (NEOSORB 70/02) | 7000 | 1682 |
| Hydrogenated starch Hydrolysate n° 1 | 7400 | 1734 |
| Hydrogenated starch hydrolystate n° 2 | 7800 | 1887 |
| Mannitol | 7200 | 1700 |
| Xylitol | 7500 | 1852 |

It is observed, on examining these results, that the coating compositions according to the invention have a very distinctly lower viscosity than the controlled composition, which renders possible their use in the coating of paper.

We claim:

1. Aqueous coating composition for paper and cardboard, having a dry matter content of at least 53%, comprising pigment, binding agent comprising from 0.2 to 30% by weight, with respect to the pigment, of one or several undepolymerized starches and at least one hydrogenated sugar selected from the group consisting of sorbitol, mannitol, maltitol, xylitol, lactitol and hydrogenated starch hydrolysates, the proportions of hydrogenated sugar being from 0.40 to 20 parts by weight per 100 parts of pigment.

2. Aqueous coating composition for paper and cardboard according to claim 1, comprising from 0.5 to 30 parts by weight with respect to pigment of one or several undepolymerized starches.

3. Aqueous coating composition for paper and cardboard according to claim 1, comprising at least one hydrogenated sugar selected from the group consisting of sorbitol, mannitol, maltitol, xylitol, lactitol and hydrogenated starch hydrolysates in an amount from 0.50 to 15% by weight with respect to the pigment.

4. Aqueous coating composition for paper and cardboard according to claim 1, comprising at least one hydrogenated sugar selected from the group consisting of sorbitol, minnitol, maltitol, xylitol, lactitol and hydrogenated starch hydrolysates in an amount from 0.50 to 7.5% by weight with respect to the pigment.

5. Aqueous coating composition for paper and cardboard according to claim 1, wherein the binding agent includes one or several synthetic products selected from the group consisting of polyvinyl alcohol, polyvinyl acetate, acrylic products, styrene-butadienes, synthetic copolymers, and/or one or several proteins selected from the group comprising casein and soya proteins.

6. Method for preparing the aqueous coating composition for paper and cardboard according to claim 1, comprising forming, on the one hand, an undepolymerized starch glue, on the other hand, a pigment dispersion, mixing the starch glue and the pigment dispersion along the proportions indicated in claim 1 and introducing either into the water serving for the preparation of the starch glue and/or the pigment dispersion, or into the starch glue, or into the pigment dispersion, or into the mixture of the two or in the final coating preparation at least one hydrogenated sugar selected from the group consisting of sorbitol, mannitol, maltitol, xylitol, lactitol and hydrogenated starch hydrolysates in an amount corresponding to the proportion indicated in claim 1.

7. Method of coating paper and cardboard, comprising the application, to one or both surfaces of the paper or of the cardboard, of the aqueous coating composition according to claim 1.

* * * * *